United States Patent [19]

Tabor

[11] Patent Number: 5,060,452

[45] Date of Patent: Oct. 29, 1991

[54] GARBAGE MANAGEMENT APPARATUS AND METHOD

[76] Inventor: Donald R. Tabor, 815 Layton Rd., Anderson, Ind. 46011

[21] Appl. No.: 508,794

[22] Filed: Apr. 12, 1990

[51] Int. Cl.[5] ..... B65B 1/24; B65B 63/02

[52] U.S. Cl. ..... 53/438; 53/469; 53/529; 53/575; 100/100; 100/244

[58] Field of Search ..... 53/438, 439, 243, 392, 53/529, 575, 469; 100/244, 264, 100

[56] References Cited

U.S. PATENT DOCUMENTS

| | | | |
|---|---|---|---|
| 2,393,130 | 1/1946 | Toulmin | 100/244 X |
| 3,438,319 | 4/1969 | Raab | 100/244 X |
| 3,451,185 | 6/1969 | Tezuka | 53/438 X |
| 3,455,084 | 7/1969 | Broersma | 53/529 |
| 3,524,297 | 8/1970 | Falborg | 53/438 X |
| 3,576,162 | 4/1971 | McBrady | 53/529 X |
| 3,584,428 | 6/1971 | Falk | 53/438 X |
| 4,056,653 | 11/1977 | Akerberg | 53/529 X |
| 4,162,603 | 7/1979 | Stromberg | 53/438 |
| 4,476,665 | 10/1985 | Oberdofer | 53/575 |
| 4,602,472 | 7/1986 | Ampolini | 53/438 |

*Primary Examiner*—John Sipos

*Attorney, Agent, or Firm*—Woodard, Emhardt, Naughton, Moriarty & McNett

[57] ABSTRACT

A mobile or stationary apparatus receives refuse in a bin or a chute. The refuse is consolidated by a first moveable shell into a transfer station of generally cylindrical shape. The member serves as a guide as the consolidated refuse is pushed by a compactor ram from the transfer station into a compactor chamber in a bagging station by a transfer actuator which, while transferring the refuse, compacts and crushes it. The bagging station includes a moveable piston against which the refuse is compacted and crushed. Then the baggage station is moved out-of-line with the transfer/compactor ram to a position where a fabric-coated impermeable bag is be installed over an open end of the bagging station. An ejector ram in the bagging station is operated to drive the cylindrical block of compacted refuse into the bag. The bag is sealed snugly around the refuse block and ready for delivery to the dumping site. The bag material is designed to permanently encase the compacted refuse block forever. When delivered to the dumping site, the bagged block units may be buried or may be stacked at ground surface for observation over a period of time to determine if any leakage exists, before burying or covering them with fill dirt.

15 Claims, 3 Drawing Sheets

"A" "B"
3
3

GARBAGE MANAGEMENT APPARATUS AND METHOD

BACKGROUND OF THE INVENTION

1. Field of the Invention

This invention relates generally to waste disposal, and more particularly to apparatus and method for collection, transport and disposal of the type of waste typically known as garbage or trash, and hereinafter referred to generally as refuse.

2. Description of the Prior Art

Refuse collection has been handled for many years in various ways, some of them relatively simple and others more complex. The simpler procedures involve collection in cans or drums at residential or light commercial sites. The cans are then dumped into trash trucks which have means for lightly compacting the trash into a compartment as the truck moves along. At the disposal site, the compartment is dumped by a mechanism having some similarities to dump trucks.

A slightly more complex system involves the use of relatively large bins at commercial or industrial sites and which are hauled bodily onto a truck or trailer bed and then transported thereby to the dump site, where they are dumped.

The dumping site is typically a landfill. Landfill operation are coming under increasing scrutiny due to the discovery that many of them have been used as depositories for hazardous waste products. Even where such products are containerized, there have been many instances where the containers have ruptured or corroded and the hazardous materials have leached out into and through the ground. For those hazardous waste products which have not been containerized, there is nothing to prevent them from leaching directly into the soil. In some cases, particularly with new landfills, an effort has been made to avoid the passage of leacheate into the ground, by lining the landfill with some impervious product such as a rubber membrane. Such a technique may cost on the order of an extra $100,000 per acre of landfill. In addition, there is no certainty that there will not be punctures or tears such as to compromise the effectiveness of the rubber lining. Accordingly, there is very little certainty that the leacheate problem will be avoided, even in such landfills.

Considering the space and volume required for landfills, there has been considerable attention given t the possibility of making packaging for various consumable products out of biodegradable materials. Similarly, some trash bags are being made of biodegradable material. However, it has been found that some such materials do not degrade in the absence of sunlight. If that is the case, the volume required by such materials in a landfill, does not significantly decrease in any reasonable period of time.

Finally, although there have been efforts to do some recycling of waste materials, such techniques are still relatively impractical, since they are neither totally effective nor are they reasonably economical. Moreover, there is not seen any real likelihood of significant progress in the future in that regard.

The present invention is addressed to refuse management according to a different concept.

SUMMARY OF THE INVENTION

Described briefly, according to a typical embodiment of the present invention, at the refuse collection site, a mobile or stationary apparatus is provided which will receive the refuse in a bin or a chute. The refuse in the bin or chute chamber is consolidated by a first moveable member into a transfer station of generally cylindrical shape. The consolidated refuse is transferred from that station into a bagging station by a transfer actuator which, while transferring the refuse, compacts and crushes it. The bagging station includes a moveable wall against which the refuse is compacted and crushed. Then the bagging station is moved out-of-line with the transfer actuator to a position where a bag can be installed over an open end of the bagging station. Then the actuator in the bagging station is operated to eject the compacted refuse as a substantially solid cylindrical block into the bag, whereupon the bag is sealed snugly around the refuse block and ready for delivery to the dumping site.

The bagging material is an impermeable membrane with a fabric fused to the exterior of it and designed to permanently encase the compacted refuse block forever. When delivered to the dumping site, such units of bag-encased refuse blocks may be buried or may be stacked at ground surface for observation over a period of time to determine if any leakage exists, before burying the units or covering them with fill dirt.

DESCRIPTION OF THE PREFERRED EMBODIMENT

Figures 1, 2:
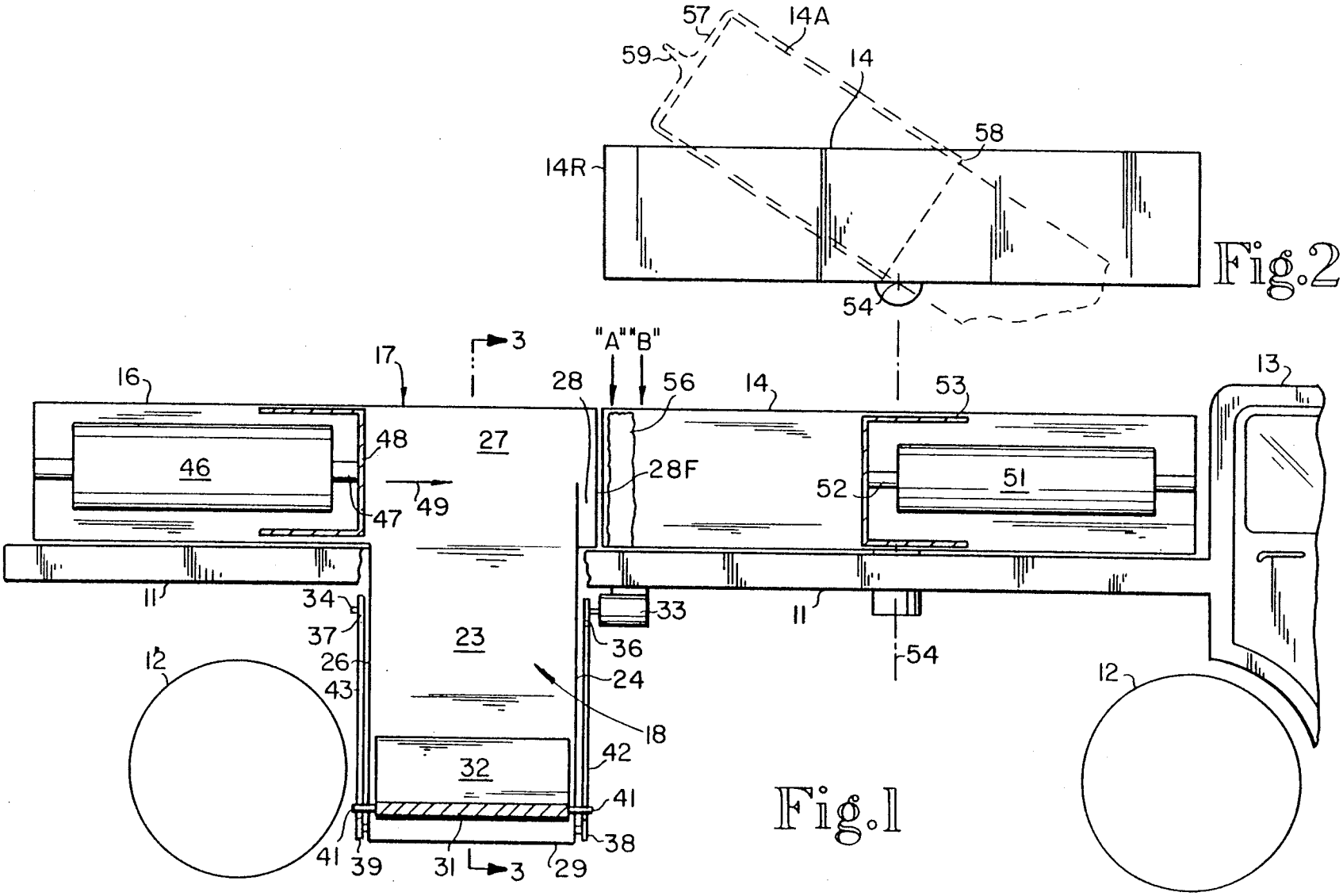
FIG. 1 is a fragmentary diagramatic longitudinal sectional view through a truck having the garbage management apparatus according to a typical embodiment of my invention.
FIG. 2 is a fragmentary top plan view of the bagging section thereof.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, FIG. 1 shows a truck having a bed 11 supported by the wheels 12, and an operator's cab 13 at the front end of the bed. There are two major hollow cylindrical structures mounted on the bed. One is the bagging station cylinder 14 immediately behind the cab. The other is the transfer piston housing cylinder 16. A transfer station structure is shown at 17 between the two cylindrical structures 14 and 16.

There is a refuse receiving chamber 18 having a top 19 (FIG. 3), bottom 21, open end 22 and closed end 23. It has a front wall 24 and back wall 26 (FIG. 1). There is a semi-cylindrical ceiling portion 27 at the left-hand end (FIG. 3) of the top wall 19 and which serves as the ceiling of the transfer station 17. There is no bottom of the transfer station, as is evident in FIG. 1. However, there is a cylindrical portion 28 projecting slightly forward from the front wall 24. There is a pit 29 at the left-hand end (FIG. 3) of bottom wall 21 and immediately under the transfer station. An elevator platform 31 resides in this pit. It has a semi-cylindrical top surface 32 having essentially the same radius as the cylindrical portion 28. A door (not shown) may be provided to cover the opening 22, if desired.

Referring to FIG. 1, means are provided to raise and lower the elevator platform 31. In this illustration, it comprises a pair of chains at the front and rear walls 24 and 26, respectively of the receiver chamber but directly under the transfer station. For example, bed-mounted motor 33 can drive a shaft 34 having a sprocket 36 adjacent the front wall and a sprocket 37 adjacent the rear wall near the top of the elevator shaft, with chains 42 and 43 driving a sprocket 38 adjacent the front wall and a sprocket 39 adjacent the rear wall near the bottom of the elevator shaft. A rod 41 extending the length of the platform 31 and through vertical slots in the front and rear walls 24 and 26 of the elevator shaft, is fixed to a link on the chain 42 adjacent the front wall 24 and is fixed to a link on the chain 43 adjacent the rear wall 26. Additional chains (not shown) are provided at the front and rear of the elevator shaft in the same manner for connection to another rod 44 secured to and extending longitudinally through the elevator platform near the right-hand side of it. All of the chains and sprockets may be driven in unison by the motor 33 to raise or lower the elevator platform 31.

A hydraulic cylinder 46 is located in the cylindrical housing 16 and has a piston rod 47 at its front end connected to the piston 48 which can be driven forward in the direction of arrow 49 by the cylinder 46. Similarly, a hydraulic cylinder 51 is mounted in the front end of the bagging cylinder 14 and has a piston rod 52 extending from the rear end thereof and capable of driving the piston 53 rearward in cylinder 14. Cylinder 14 is mounted to the bed 11 to swivel about a vertical axis 54 to the position shown by the dotted outline 14A (FIG. 2) for a purpose which will be described hereinafter. Normally the rear end 14R of cylinder 14 is very closely associated, with almost zero clearance, with the front end 28F of the cylindrical portion 28 at the front end of the transfer station 17. Both of the hydraulic cylinders 46 and 51 are double acting cylinders, but cylinder 46 is slightly larger in diameter so that, if the same pressure is applied to both cylinders 46 and 51, piston 48 is capable of applying a greater linear force forward than is the piston 53 capable of driving to the rear.

Figure 3:
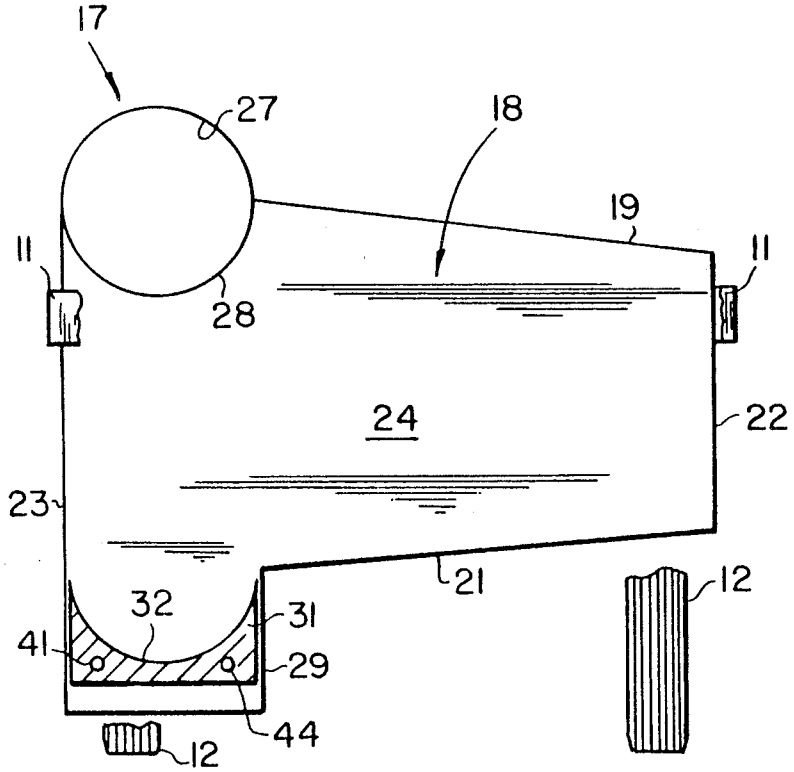
FIG. 3 is a diagramatic rear elevational view of the truck with a cross section through the receiver chamber taken at line 3—3 in FIG. 1 and viewed in the direction of the arrows.

In the operation of the embodiment of FIGS. 1–3, refuse can be thrown through the opening 22 into the chamber 24. It will move down the sloped surface 21 into the concave upper surface 32 of the elevator platform. With the hydraulic pistons retracted so that they are in the position shown in FIG. 1, the elevator platform is driven upward by motor 33 to consolidate the trash into what becomes a relatively small cylinder in the transfer station 17, that cylinder being created by the semi-cylindrical upper surface or ceiling 27 of the transfer station, and the upwardly concave semi-cylindrical surface 32 of the elevator platform. The receiver piston 53 is extended by cylinder 51 to the location "B" where it stops. With the elevator held fixed at the elevated position cooperating with the ceiling 27 to provide the transport cylinder, the actuator cylinder 46 for piston 48 begins driving that piston forward in the direction of arrow 49. This pushes the refuse against the piston 53, thereby crushing any crushable refuse and compacting it into the cylinder volume between the locations A and B in the bagging cylinder 14. Thereby, a cylinder wafer or disk 56 of highly compacted refuse is made between the two pistons 48 and 53 as shown in FIG. 1.

Then the elevator platform 31 can be lowered by operation of motor 33 in reverse until the elevator has returned to the original position shown in FIGS. 1 and 3. Then more refuse in chamber 18 can fall into or be pushed into or thrown into the space on top of the platform 31. Meanwhile, the piston 48 can be withdrawn to the starting position shown in FIG. 1. It is preferable that piston 53 remain extended to the line B, but the pressure can be removed from it until the next crushing stroke of piston 48. Then the procedure of elevating the platform 31, and driving the refuse to the right and crushing it in the process is repeated. Since the cylinder 46 is larger than cylinder 51, piston 53 will not be able to maintain the location at line B but will be forced to the right as piston 48 is again advanced to the location A. However, because the same total force is exerted by the cylinder 51 on piston 53 as during the first crushing stroke, the new batch of crushed refuse will again not likely take more lineal space than that shown between the lines A and B in FIG. 1 as with the first batch.

The foregoing operation is repeated continuously until the piston 53 has been driven back by the successive slugs of compressed compacted refuse to the original location of piston 53 as shown in FIG. 1. When that has been done, a tightly packed substantially solid cylindrical block of refuse approximately two feet in diameter, and as long as the space between line A and the rear end of the piston 53, has been made. That distance can be anywhere from four to six feet, depending upon the sizing of the cylinders and the stroke of the pistons.

When the cylindrical block of the compacted refuse has been made as described above, the cylinder 14 can be swiveled clockwise as viewed from above, about the pivot axis 54 to a position such as shown in FIG. 2. Then a bag 57 is mounted on the cylinder, the open end 58 of the bag being pushed on first over the outside of cylinder 14. The closed and sealed end 59 of the bag is at the outside. The bag is long enough to be able to fully enclose the cylindrical block of compacted refuse. Then the cylinder 51, which has been depressurized prior to the swinging of the cylinder 14 to the discharge position shown in FIG. 2, is again activated slowly to eject the bagged block of compacted refuse as covered with the bag from the end 14R of cylinder 14. Then the other end of the bag can be folded together and heat sealed closed.

The material for the bag is a special combination of an olefin membrane with a polyester fabric. The olefin is a Himont brand RA-061 thermoplastic olefin. It is combined with a Foss brand polyester fabric by Foss Manufacturing Company. These materials are rolled together at the end of the extrusion of the olefin rubber and before the combination hits the nip rolls which iron out the combination to the desired thickness. This is done by United Technologies, Greenville, Ohio. The rubber is an ethylene-propylene rubber olefin membrane weighing approximately three ounces per square yard. Depending upon the strength desired for the bag, the weight could be anywhere from three to ten ounces per square yard. This material is available from SunSet Engineering, Inc. of Anderson, Ind. Thus, there is produced a hermetically sealed bag of compacted refuse which has been compacted under a lineal force of approximately 200 tons applied by the closure of the pistons 48 and 53 on the refuse. These bagged refuse block units can be stored on the truck bed for later hauling to the dumping site or can be deposited at locations along the trash route for pick-up later by another vehicle for delivery to a dumping site. At the dumping site, these units can be stacked horizontally on the top of the ground and monitored for leaks, if desired. If no leakage is found, they can then be buried or they can be covered with dirt, as and where located, as in normal landfill practices.

Figure 5:
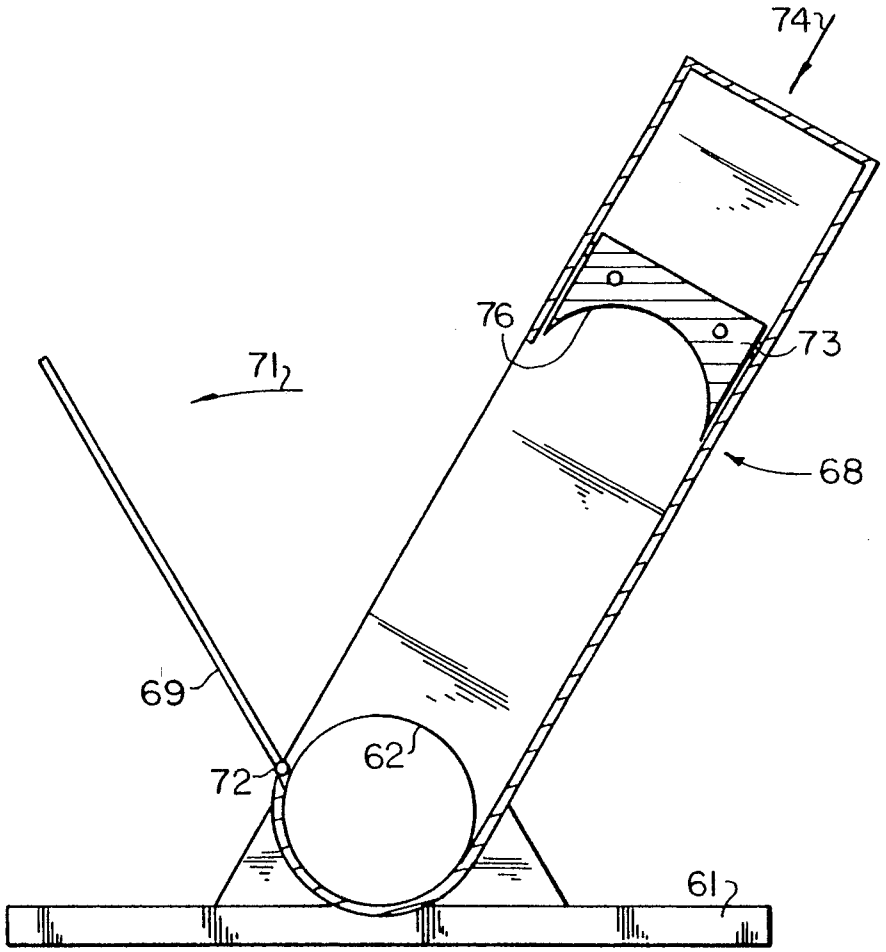
FIG. 5 is a diagramatic cross sectional view taken at line 5—5 in FIG. 4 and viewed in the direction of the arrows.
Figure 4:
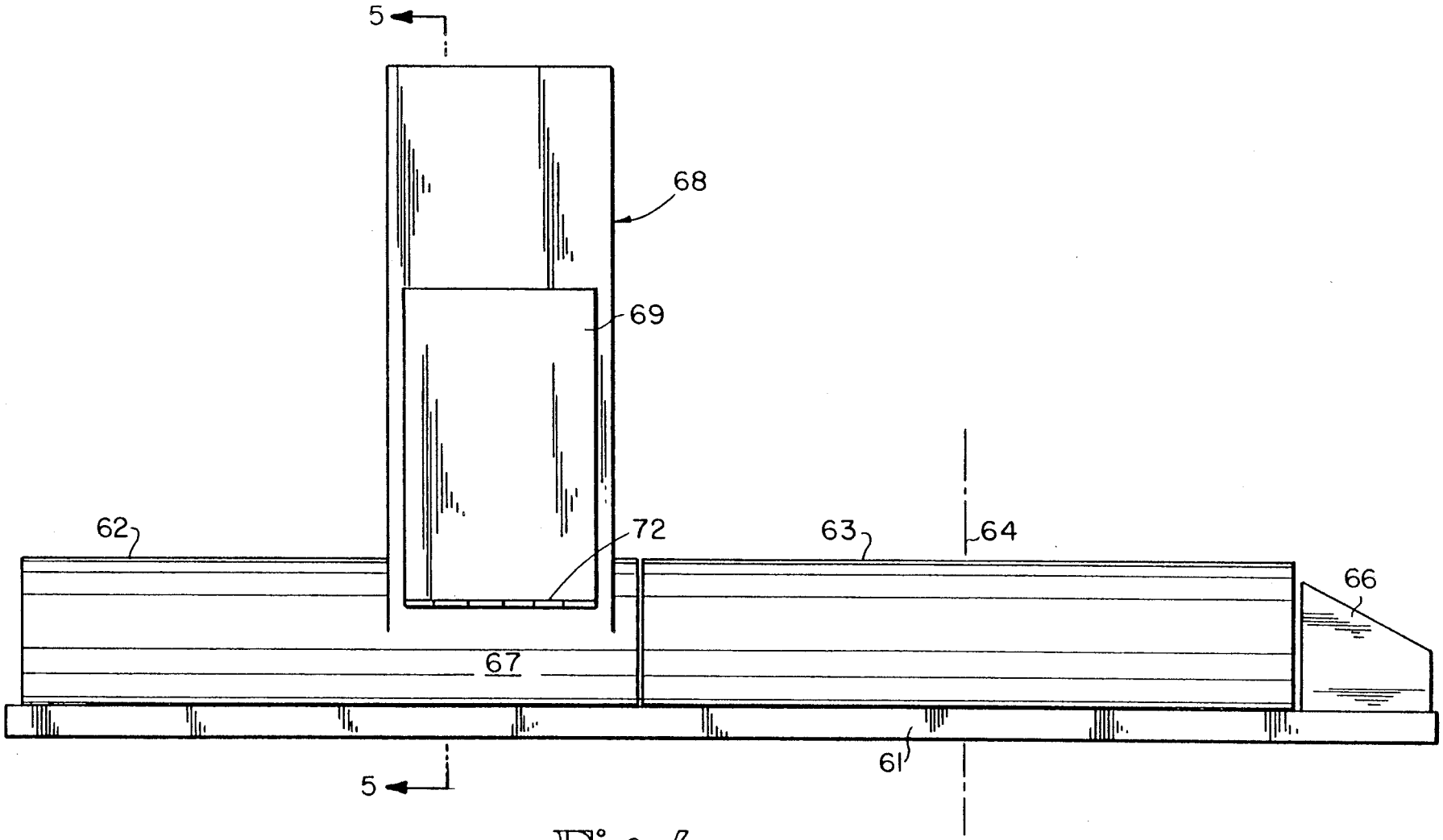
FIG. 4 is a diagramatic front elevational view of an alternate embodiment of the present invention incorporated in a stationary machine.

Referring now to FIGS. 4 and 5, instead of a mobile truck bed 11, these views illustrate a stationary base 61 which rests on the ground. A transport cylinder 62 of the same type of construction and content as cylinder 16 of FIG. 1 is secured to the base. A bagging cylinder 63 of the same type of construction and content as cylinder 14 in FIG. 1 is swivel mounted to the base 61 for swiveling on vertical axis 64 as described above for cylinder 14 on axis 54. A power pack for hydraulic fluid and controls is provided in housing 66 mounted to the base.

The transfer station is located at 67 but, instead of having a generally horizontal input of material, and an elevator under it, the construction is more in the nature of a hopper 68 which is of generally rectangular cross section and has a door 69 at the front which can be swung outward in the direction of arrow 71 (FIG. 5) about the hinge 72. Instead of an elevator platform 31 for consolidation of the trash into the transfer station 67, the FIG. 4 and 5 machine includes a consolidating block 73 which is of rectangular cross section when viewed in the direction of the arrow 74, just as is the elevator platform 31 when viewed from below. It has a concave semi-cylindrical lower face 76 which, when the block 73 is in its lowermost position, cooperates with the semi-cylindrical portion of the cylinder 62 at the transfer station 67 to form a cylinder at the transfer station, just as occurred when the elevator surface 32 cooperated with the ceiling surface 27 at the transfer station 17 in FIG. 1. Consequently, when the piston in cylinder 62 is driven to the right, it will drive the consolidated trash in the cylinder formed at the transfer station 67 into the cylinder 63 and against the piston in that cylinder to provide a compacted wafer of refuse like wafer 56 in FIG. 1. Subsequent operations in this embodiment will achieve the sam type of consolidated cylindrical block of refuse as described above. When the maximum length achievable has been made, the cylinder 63 may be swung about the axis 64 for bagging and ejecting the bagged block, as described above.

The downward drive for the consolidating block 73 can be accomplished after the door 69 is closed and secured, by the use of a drive mechanism as previously described for the FIG. 1–3 embodiment. Where rods such as 41 and 42 are employed, slots in the front and rear walls of the guideways can be provided. Other types of linear drives might also be used in both embodiments, such as hydraulic, rotary screw drives, or other systems.

The present invention makes it possible to manage refuse in a very convenient and reliable way.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a refuse handling vehicle having road wheels and carriage means supported on the road wheels and a refuse receiver chamber to receive refuse deposited in it, the improvement comprising:

a transfer station located above said chamber;

an elevator associated with the chamber and movable upward through a portion of the chamber to the transfer station to lift refuse from the chamber to the transfer station;

a crushing ram associated with the transfer station to crush and compact refuse delivered to the transfer station by the elevator and to move said crushed and compacted refuse out of the transfer station;

a bagging station adjacent the transfer station to receive crushed and compacted refuse moved by the crushing ram; and means at the bagging station for moving the crushed and compacted refuse into a bag.

2. The improvement of claim 1 wherein:

the ram has a circular piston;

the elevator has a semi-cylindrical platform top; and the transfer station has a semi-cylindrical ceiling whereby the platform top and the ceiling form a cylindrical transfer station chamber when the elevator platform has moved up to the transfer station.

3. The improvement of claim 2 wherein:

the cylindrical transfer station chamber has a longitudinal axis on a line which extends through the center of the piston.

4. The improvement of claim 3 wherein:

the bagging station has a cylindrical bagging chamber having a cylindrical axis on said line.

5. The improvement of claim 4 and wherein the means for moving include:

a receiver ram at the bagging station to provide an anvil for compacting the trash at the bagging station, the receiver ram having a circular piston centered on said line.

6. The improvement of claim 5 and wherein:

at least a portion of the bagging station is horizontally moveable out of alignment of the bagging chamber axis with the transfer station chamber axis to enable placement of a cylindrical bag around a portion of the bagging chamber for bagging the compacted refuse.

7. The improvement of claim 6 and wherein:

the moveable portion is adjacent the transfer station and, when moved, presents an open end of the bagging chamber for receiving the bag around it; and the ram is moveable longitudinally in the bagging chamber to force compacted refuse out of the open end into the bag around it.

8. The improvement of claim 7 and wherein:

the moveable portion is moveable by swiveling the bagging station about a substantially vertical axis.

9. The improvement of claim 7 and wherein:

the rams are hydraulic cylinder and piston assemblies, each having a loading capacity of two tons.

10. In a refuse receiving apparatus having a receiver chamber to receive refuse deposited in it, the chamber having an end wall toward which refuse is moved in the chamber, the improvement comprising:

a transfer station at the end wall;

drive means associated with the receiver chamber and movable in one direction through a portion of the chamber toward the transfer station to move and consolidate refuse into the transfer station;

a bagging station adjacent the transfer station;

a transfer actuator at the transfer station and arranged to move the refuse in a direction transverse to said one direction, from the transfer station to the bagging station; and a receiver actuator at the bagging station for moving the refuse into a bag and operable to limit movement of refuse by the transfer actuator for crushing and compacting the refuse between the transfer actuator and the receiver actuator.

11. The improvement of claim 10 and further comprising:

the transfer station having a semi-cylindrical wall and the drive means having a semi-cylindrical wall whereby the two semi-cylindrical walls cooperate to form a cylindrical transfer station chamber when the drive means has moved refuse to the transfer station;

the cylindrical chamber having a longitudinal axis.

12. The improvement of claim 11 and wherein:

the receiver actuator includes an ejection ram in the bagging station.

13. The improvement of claim 11 and wherein the bagging station includes a bagging cylinder having an axis colinear with the axis of the transfer station chamber, the improvement further comprising:

means for moving at least a portion of the bagging station out of alignment with the transfer actuator whereby the said axes are not colinear, to facilitate installation of a bag on the bagging station.

14. The improvement of claim 13 and wherein:

the bagging station is swivel mounted whereby said means for moving out of alignment rotates the bagging station out of alignment.

15. A method of handling refuse comprising the steps of:

placing the refuse in a receiving chamber;

consolidating the refuse into a transfer station;

confining the refuse in the transfer station and pushing it therefrom in one direction into a crushing and compacting chamber;

compacting the refuse in the compacting chamber;

using a portion of a compacting member as a confining member and guide for the refuse as the refuse is pushed into the compacting chamber;

moving the compacting chamber away from the transfer station to facilitate ejection of the compacted refuse into a bag;

placing a bag of fabric coated plastic onto a part of the compacting chamber before ejecting the compacted refuse into the bag; and moving the compacted refuse from the compacting chamber by said compacting member into a bag mounted on the compacting chamber.

* * * * *